US008365704B2

(12) United States Patent
Beilharz et al.

(10) Patent No.: US 8,365,704 B2
(45) Date of Patent: Feb. 5, 2013

(54) METHOD AND DEVICE FOR FORMING AN ELECTRIC CONTROL SIGNAL FOR AN INJECTION IMPULSE

(75) Inventors: Jörg Beilharz, Berlin (DE); Uwe Lingener, Regensburg (DE); Andreas Pfeifer, Sinzing (DE); Richard Pirkl, Regensburg (DE); Harald Schmidt, Vienna (AU); Klaus Wenzlawski, Nürnberg (DE); Hans-Jörg Wiehoff, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 460 days.

(21) Appl. No.: 12/669,129

(22) PCT Filed: Jun. 26, 2008

(86) PCT No.: PCT/EP2008/058130

§ 371 (c)(1),
(2), (4) Date: Jun. 14, 2010

(87) PCT Pub. No.: WO2009/010374

PCT Pub. Date: Jan. 22, 2009

(65) Prior Publication Data

US 2010/0288238 A1 Nov. 18, 2010

(30) Foreign Application Priority Data

Jul. 18, 2007 (DE) ..... 10 2007 033 469

(51) Int. Cl.
*F02D 41/40* (2006.01)
*F02D 41/20* (2006.01)
*F02M 51/06* (2006.01)

(52) U.S. Cl. ..... 123/480; 123/478; 123/456

(58) Field of Classification Search ..... 123/480, 123/478, 486, 456, 457, 467, 498, 447
See application file for complete search history.

(56) References Cited

U.S. PATENT DOCUMENTS 4,602,600 A * 7/1986 Akatsuka et al. ..... 123/479

(Continued)

FOREIGN PATENT DOCUMENTS

DE 19714607 10/1998

(Continued)

OTHER PUBLICATIONS

German Office Action for Application No. 10 2007 033 469.0 (3 pages), Dec. 17, 2007.

(Continued)

*Primary Examiner* — Hieu T Vo
(74) *Attorney, Agent, or Firm* — King & Spalding L.L.P.

(57) ABSTRACT

In a method or a device for forming an electric control signal for an injection impulse of a position-controlled fuel injector, particularly of a common-rail or pump-nozzle injection system, the course of the electric control signal can be selected freely in regard to the pulse edges (injection rate changes Q), the holding period (Δt) and the injection rate (Q). This offers the advantage that the combustion process can be better optimized with respect to low emissions, low consumption and for meeting tightened legal regulations.

20 Claims, 4 Drawing Sheets

U.S. PATENT DOCUMENTS

| | | | | |
|---|---|---|---|---|
| 6,142,121 | A * | 11/2000 | Nishimura et al. | 123/456 |
| 6,820,474 | B2 | 11/2004 | Rueger et al. | 73/119 |
| 6,849,988 | B2 | 2/2005 | Rueger | 310/316.03 |
| 6,863,055 | B2 | 3/2005 | Rueger | 123/478 |
| 6,973,919 | B2 | 12/2005 | Joos et al. | 123/478 |
| 7,318,419 | B2 | 1/2008 | Dietl et al. | 123/478 |

FOREIGN PATENT DOCUMENTS

| | | |
|---|---|---|
| DE | 19921456 | 11/2000 |
| DE | 10011711 | 10/2001 |
| DE | 10016476 | 12/2001 |
| DE | 10148217 | 4/2003 |
| DE | 10155390 | 5/2003 |
| DE | 10340975 | 3/2005 |
| DE | 102004006558 | 9/2005 |
| EP | 1138912 | 10/2001 |
| EP | 1607609 | 12/2005 |
| WO | 0114714 | 3/2001 |
| WO | 02077432 | 10/2002 |
| WO | 2004038203 | 5/2004 |

OTHER PUBLICATIONS

International Search Report and Written Opinion for Application No. PCT/EP2008/058130 (11 pages), Nov. 4, 2008.

* cited by examiner

METHOD AND DEVICE FOR FORMING AN ELECTRIC CONTROL SIGNAL FOR AN INJECTION IMPULSE

CROSS-REFERENCE TO RELATED APPLICATIONS

This application is a U.S. National Stage Application of International Application No. PCT/EP2008/058130 filed Jun. 26, 2008, which designates the United States of America, and claims priority to German Application No. 10 2007 033 469.0 filed Jul. 18, 2007, the contents of which are hereby incorporated by reference in their entirety.

TECHNICAL FIELD

The invention relates to a method and a device for forming an electric control signal for an injection impulse of a position-controlled fuel injector of a common rail or a pump nozzle injection system.

BACKGROUND

Fuel injectors are already known which are for example equipped with a piezoelectric actuator. The piezoelectric actuator has the characteristic that on the one hand it can convert an electric signal very quickly into a mechanical lifting movement. In addition, the piezoelectric actuator has the characteristic that, in the event of a mechanical compressive load, it emits an electric signal so that it at the same time can be used as a sensor for recording the prevailing pressure in the fuel injector or in the injection system.

Assisted by the mechanical lifting movement of the actuator, a nozzle needle is controlled by means of which injection holes within a nozzle unit can be opened wide or less wide. By recording the current pressure or the dynamic change in the fuel injector, it is possible to decide on the lifting movement of the nozzle needle. In this way, the nozzle needle can in the case of a corresponding forming of an electric control signal be controlled to a specific, predetermined position.

However, known electronic management systems for controlling combustion engines are not in the position to achieve a low-emission and low-consumption operation of the internal combustion engine to a sufficient extent with the assistance of a position-controlled fuel injector.

In addition, it is also known that the mixture-forming process within a cylinder of the internal combustion engine can essentially be influenced by the exchange of gas as well as the fuel injection volume and by the course of the injection rate. Until now, this problem was solved by the fuel injector used, because of constructional measures, having corresponding hydraulic-mechanical features. However, these measures do not suffice to meet all the requirements for future combustion requirements, in particular also with respect to planned legal regulations.

A further problem also consists in that the exact recording of the actually injected fuel quantity as well as the point in time of the injection has only been able to be resolved unsatisfactorily thus far. In particular, problems arise because the fuel injectors used are manufactured with an inevitable manufacturing tolerance, so that the problem of accurately recording of the fuel quantity actually injected has thus far only been resolved in an unsatisfactory manner.

SUMMARY

According to various embodiments, a method or a device can be created by means of which the fuel injection into a cylinder of an internal combustion engine is improved with respect to optimizing the combustion process.

According to an embodiment, in a method for forming an electric control signal for an injection impulse of a fuel injector, in particular a common rail or a pump nozzle injection system, with the electric control signal preferably activating a piezoelectric actuator of the fuel injector in order to inject a predetermined fuel quantity into a cylinder of an internal combustion engine and with the assistance of the course of a curve of the electric control signal, an injection rate of the fuel injector being regulated in particular as a function of the rail pressure, the height of lift and/or the opening period of the fuel injector, wherein for at least a part quantity to be injected, the course of the electric control signal can be formed freely with regard to at least one pulse edge and/or an amplitude, wherein the forming of the injection impulse is embodied in such a way that the predetermined fuel quantity to be injected remains constant independent of the course of the electric control signal.

According to a further embodiment, the injection impulse for the injection of a part quantity can subsequently be embodied by means of an intermediate level with a first amplitude. According to a further embodiment, a change in the injection rate can be predetermined for forming the injection impulse. According to a further embodiment, a holding time can be predetermined for the intermediate level. According to a further embodiment, the injection impulse starting from the intermediate level can be set with a second change in the injection rate to a higher level with a second amplitude. According to a further embodiment, for the second amplitude, a predetermined second holding time can be predetermined. According to a further embodiment, starting from the second amplitude, a speed regulation breakaway with a third change in the injection rate can be predetermined. According to a further embodiment, the number of intermediate levels, the holding period and/or the changes in the injection rate can be selected at random. According to a further embodiment, according to the course of the curve, an actually injected fuel quantity can be determined and the actually injected fuel quantity can be compared to a predetermined fuel quantity.

According to another embodiment, in a device for forming an electric control signal for an injection impulse of a fuel injector, in particular a common-rail or a pump-nozzle injection system, with a control device by means of which a piezoelectric actuator of the fuel injector can preferably be controlled in order to inject a predetermined fuel quantity into a cylinder of an internal combustion engine and with the assistance of the course of the curve of the electric signal, an injection rate of the fuel injector being regulated in particular as a function of the rail pressure, the height of lift and/or the opening period of the fuel injector,—the control device is embodied in order to freely form the course of the curve of the electric signal with regard to at least one pulse edge and/or an amplitude, wherein the formation of the electric signal is embodied in such a way that the predetermined fuel quantity to be injected remains constant independent of the course of the electric control signal.

BRIEF DESCRIPTION OF THE DRAWINGS

An exemplary embodiment is shown in the drawing and is described in more detail below.

DETAILED DESCRIPTION

Figures 1A, 1B, 1C:
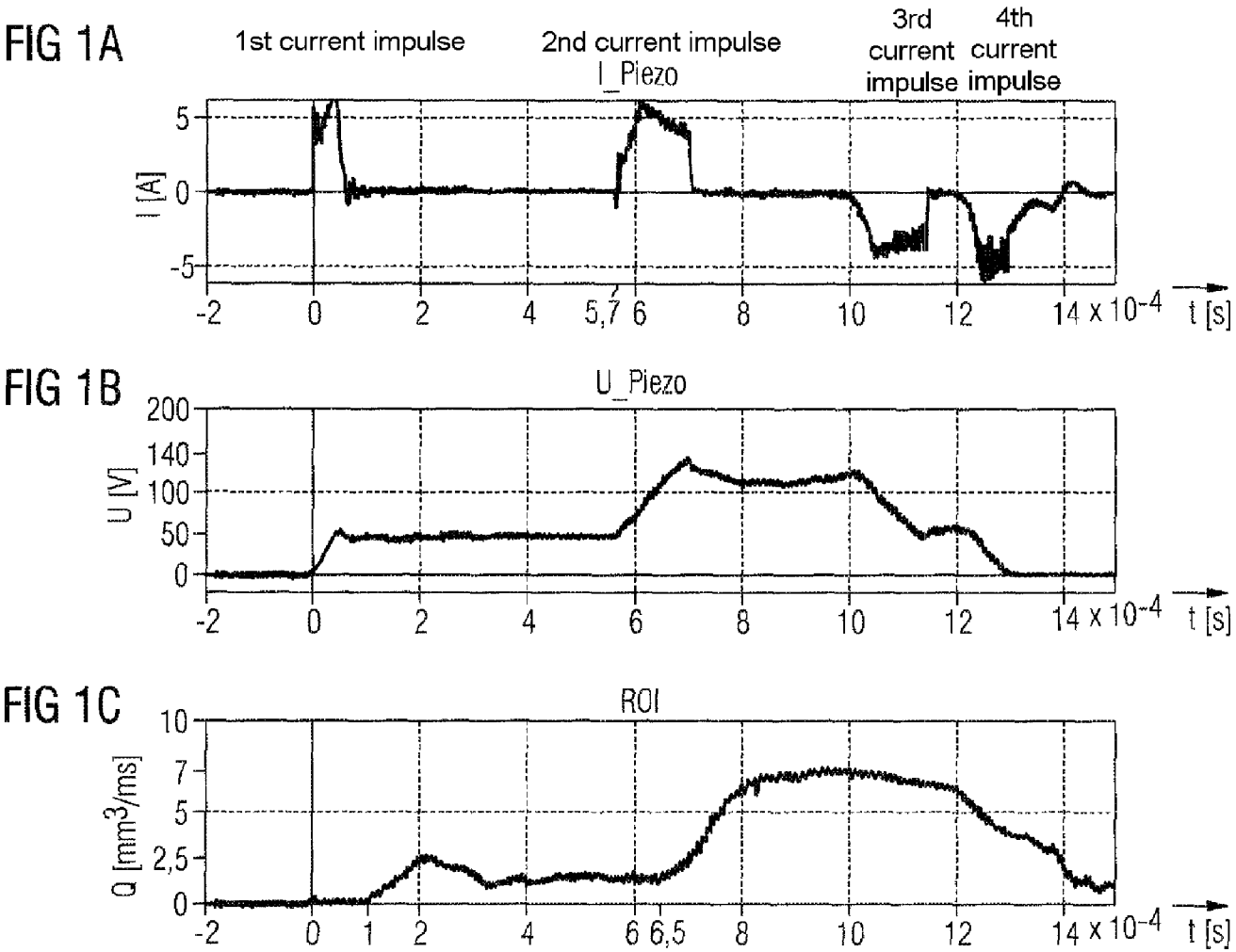
FIGS. 1 A, B, C show three diagrams with the graph of the control current and the control voltage on the actuator as well as the relation to time with the injected fuel quantity.

The advantage of the method or the device in accordance with various embodiments for forming an electric control signal for an injection impulse of a position-controlled fuel injector with the characteristic features of the subclaims 1 and 10 is that the forming of the injection impulses can be freely selected. This means that for a predetermined injection quantity the electric control signal can be formed in any given way. As a result, the fuel injection or the mixture forming can be adapted to ideal processes and optimized. It is regarded as particularly advantageous that the system developer now has more degrees of freedom and in particular can freely form one pulse edge or a plurality of pulse edges and/or at least one further amplitude. A further aspect of the various embodiments also consists in that the provided total quantity of the injection impulses is kept constant independently of the forming of the electric control signal. As a result, undesired energetic effects on the torque of the internal combustion engine are avoided.

The measures listed in the subclaims give advantageous further embodiments and improvements of the method given in claim 1. It is regarded as particularly advantageous that the electric control signal is first embodied with an intermediate level with a lower amplitude so that the nozzle needle of the fuel injector is moved into an intermediate position on opening the injection holes. As a result, a first part quantity of the predetermined fuel quantity can be injected.

For forming the electric control signal for the first part quantity, provision is made for a further embodiment, namely that the change in the injection rate is predetermined.

A further degree of freedom for the first part injection is also seen in that the holding time for keeping the intermediate position of the fuel injector is predetermined. By varying the change in the injection rate and/or also the holding time for the intermediate position, an almost random injection behavior can be generated and as a result, the combustion of the fuel-air mixture in the cylinder of the internal combustion engine can be optimized further.

In a further embodiment, provision is made for the fact that the introduction for the injection of a second part of the predetermined injection quantity sets the electric control signal at a higher level with a higher amplitude. As a result, the nozzle needle of the fuel injector is controlled to a second holding position so that a second, higher level for the fuel injection is reached.

Provision is further made in accordance with various embodiments for a second holding time to be predetermined for the opening period of the nozzle needle.

Accoridng to another embodiment, the number of intermediate levels, the holding period, and/or the changes in the injection rate being able to be selected as required. As a result, there is a very simple adaptation to each random embodiment of the injection process. In particular, the nozzle needle can be explicitly captured on placing it on its valve seat. As a result, an improved reproducibility of the dosage of the fuel quantity as well as a decrease in the noise development are advantageously obtained. In addition driving comfort is also improved together with a lower combustion noise.

For better understanding of the various embodiments, the diagrams shown in FIGS. 1 A, B, C are explained in more detail below. The three diagrams show the theoretical graph of the control current I, the control voltage U for a piezoelectric actuator of a fuel injector as well as a corresponding graph of an injected fuel quantity in relation to time.

FIG. 1A shows the current I as a function of the time t, which can be measured directly on a piezoelectric actuator. The piezoelectric actuator has a capacitive behavior, i.e. a positive charge current flows in the actuator when the voltage is increased and a negative current flows when the voltage is decreased. Should there be no change in the voltage, then the flow of current returns to 0.

As has already been mentioned, the piezoelectric actuator also has sensor properties. In particular, one can see that after the increasing current edge or the decreasing current edge, a more or less prominent oscillation of the graph of the current arises. This oscillation for example takes place because of the impact of the nozzle needles on their valve seat. However, it also takes place because of the deviations in the fuel pressure, which is determined by opening or closing the injection holes of the injection nozzle. In this way, because of a correspondingly developed forming of the electric control signal, the oscillation, which can also be referred to as a seat vibration, can be recorded, and controlled in a regulated manner. For this reason, provision is made in accordance with various embodiments that in the case of an injection impulse of the provided injection quantity, the at least one part quantity or a plurality of part quantities and subsequently the remaining fuel quantity is injected at a wider opening of the nozzle needles. In this case, both a change in the injection rate and an increasing edge of the electric control signal and an amplitude with an intermediate level and/or a holding time can be predetermined as a freely selectable parameter. From the integral plotted against the change in the injection rate and from the holding time, the actually injected fuel quantity is obtained as is explained in more detail later.

With regard to FIG. 1A, a first current impulse can be seen in the left part of the diagram at a point in time t=0.

Thereafter the current decreases to a value of 0. The second current impulse occurs at t=5.7, which is however wider than the first current impulse. A third negative current impulse Occurs at a point in time t=10 and a fourth negative current impulse at a point in time t=12.

The edges of the individual current impulses are described in more detail below.

In the diagram of FIG. 1B, the graph of the voltage U on the piezoelectric actuator is shown analogous to the graph of the current I. The voltage increases at a point in time t=0 with a predetermined edge to an intermediate value of approximately 50 volts. Thereafter a longer holding time results until the voltage increases at a point in time t=5.7 parallel to the second current impulse of FIG. 1A to approximately 140 volts. The voltage remains approximately in this range until at t=10 the voltage decreases with a predetermined edge to a further intermediate level, for example 50 volts. After a further short holding time, the voltage then again drops to the value of 0.

The dropping voltage edge in each case corresponds to a dropping current at the piezoelectric actuator.

The resulting injection quantity $\dot{Q}$ is plotted analogously to the two diagrams of FIGS. 1A and 1B in FIG. 1C.

By means of mechanical and hydraulic delays, the actual injection starts approximately at t=1 with a peak value of approximately $\dot{Q}$=2.5. Thereafter the injection quantity $\dot{Q}$ drops with a predetermined edge and then increases finally at approximately t=6.5 to a predetermined value of approximately $\dot{Q}$=7 at t=8.5. In this range, the injection of a greater part quantity takes place up to a point in time t=12 of the injection impulse and decreases with a further predetermined change in the injection rate $\ddot{Q}$ up to approximately 0. The representation of the three diagrams takes place on a comparable time axis t in the range of $10^{-4}$ seconds.

As can be gathered from the three diagrams of FIGS. 1 A, B, C, in accordance with various embodiments, in a very simple manner, by presupposing a corresponding course of the voltage for the electric control signal, the injection quantity $\dot{Q}$ or the injection rate $\ddot{Q}$ can be controlled. In addition, by means of a corresponding course of the graph, the seat throttling of the nozzle needle as well as its stability with regard to the injection rate can be influenced in an advantageous manner.

Figure 2:
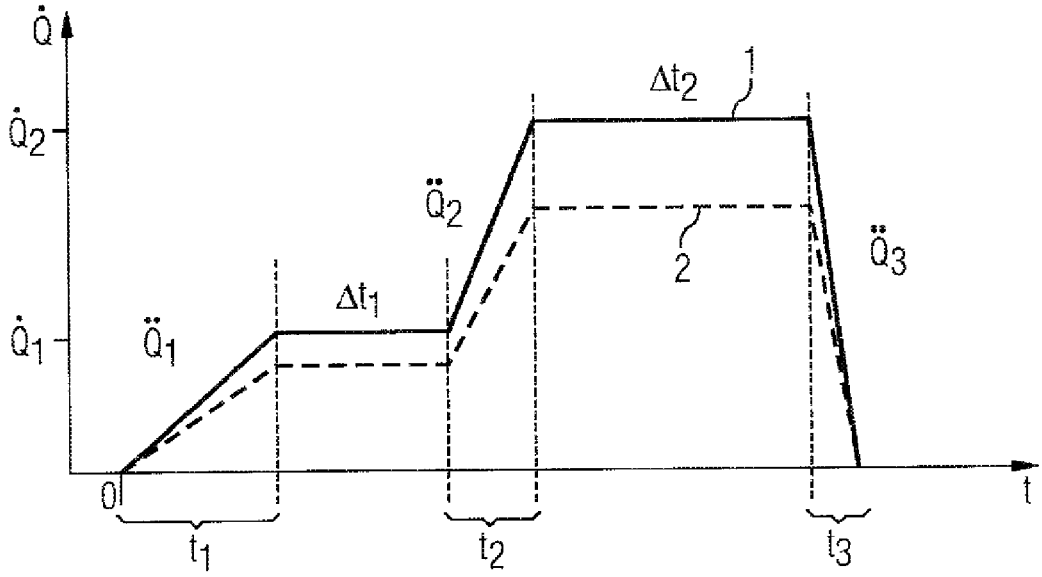
FIG. 2 shows, by way of example, a second diagram with two control signals in accordance with various embodiments.

FIG. 2 shows a diagram with for example two curves 1 and 2 in accordance with various embodiments for forming an electric control signal. These diagrams show all the parameters by means of which an injection course can be influenced. For this purpose, the injection rate (injection quantity per unit time) $\dot{Q}$ is plotted in the diagram on the Y axis and the time t on the X axis. Curves 1 and 2 are shown as example of different control signals or different injection courses. Because curves 1 and 2 schematically have the same course, only curve 1 is described in more detail below. On the other hand, curve 2 only differs in lower amplitudes of the injection rate $\dot{Q}$ and smaller changes in the injection rate $\ddot{Q}$.

Curve 1 initially increases from the value 0 up to reaching a first injection rate $\dot{Q}_1$ within a period of time $t_1$. The change in the injection rate has the value $\ddot{Q}_1$. The injection rate $\dot{Q}_1$ subsequently remains constant during a holding time $\Delta t_1$. Thereafter the electrical control signal increases with a change in the injection rate $\ddot{Q}_2$ up to the injection rate $\dot{Q}_2$ within a period of time t2. Thereafter the injection rate $\dot{Q}_2$ remains constant during a period of time $\Delta t_2$. The curve 1 subsequently drops during a period of time $\Delta t_3$ to the value 0. A change in the injection rate $\ddot{Q}_3$ is selected for the decreasing edge. This basic course for an electric control signal in accordance with various embodiments can vary as is shown for example in curve 2. For the curve 2, lower changes in the injection rates $\ddot{Q}_1$, $\ddot{Q}_2$, $\ddot{Q}_3$ are selected. The injection times t1, t2 and t3 are identical to those of curve 1. Only the maximum injection rates $\dot{Q}_1$, $\dot{Q}_2$ are reduced. As a result, there is a reduced total injection quantity, which can be calculated very easily by forming an integral as is shown below.

In order to establish an electric control signal for the activation of a position-controlled fuel injector, the following parameters have been used thus far:

a change in the injection rate $\ddot{Q}_2$,
an injection period t2,
an injection rate $\dot{Q}_2$,
a holding time $\Delta t_2$ and
a change in the injection rate $\ddot{Q}_3$ The specified parameters are no longer sufficient for future injection methods in the case of piezoelectrically-operated injection systems. It is therefore proposed in accordance with various embodiments that the well-known parameters are extended by means of the following parameters:

a change in the injection rate $\ddot{Q}_1$,
a period of time $t_1$,
an injection rate $\dot{Q}_1$,
a holding time $\Delta t_1$.

The parameters in accordance with various embodiments can be selected freely. In a further embodiment, provision is made for the electric control signal to be embodied for further intermediate levels.

In the case of the exemplary embodiment, for reasons of simplification only a single part quantity is shown. This part quantity is established by means of the new parameters in accordance with various embodiments:

With a change in the injection rate $\ddot{Q}_1$, the first part quantity increases to the injection rate $\dot{Q}_1$ within a period of time $t_1$. The injection rate $\dot{Q}_1$ remains constant during the holding time $\Delta t_1$. The injection rate $\ddot{Q}_2$ is subsequently reached with a change in the injection rate $\ddot{Q}_2$ within the period of time $t_2$. The injection rate $\ddot{Q}_2$ remains constant during the holding time $\Delta t_2$. Subsequently, the control signal drops during a period of time $\Delta t_3$ and with the change in the injection rate $\ddot{Q}_3$ to the value 0.

The total injection quantity can be calculated by forming an integral over the entire curve.

It is of significance for various embodiments that a variation in the additional parameters does not attract any influencing of the desired total quantity for the predetermined fuel injection. For this purpose, it is particularly essential that a transformation of the desired injection rates and their injection rate courses are carried out. In this case, it must also be taken into account that the electric control parameters also have a corresponding influence on the hydraulic values in the actuator path. When taking into account all the factors, it is possible to determine the fuel quantity actually injected in an accurate and reproducible manner so that the combustion sequence of the fuel-air mixture can be regulated optimally.

An algorithm is given below by means of which in general a desired injection quantity Q can be calculated in accordance with the following formulas:

$$Q=\int Q(t)dt=f(\ddot{P},[t_1, t_2, t_3])$$

with $$\ddot{P}=[\ddot{Q}_1, \ddot{Q}_2, \ddot{Q}_3, \Delta t_1, \Delta t_2]$$

and $$\ddot{Q}=d\,\dot{Q}(t)/dt=\text{const}$$

as well as $$Q=\dot{Q}*t$$

For a desired combustion graph, the following listed parameters of the electric control signal desired fuel quantity Q to be injected,
the change in the injection rate $\ddot{Q}_1$,
the injection rate $\dot{Q}_1$ as well as
the holding time $\Delta t_1$, are for example determined on a correspondingly equipped test engine or in a vehicle by way of experiment and saved in a table, with the determination depending on the type of fuel injector of a common rail or a pump-nozzle injection system. After a suitable choice of the change in the injection rate $\ddot{Q}_3$ and establishing system-controlled boundary values, the remaining parameters are obtained as a solution of a non-linear optimization with corresponding boundary conditions.

After the solution has been found, a transformation to the electric control values takes place according to FIGS. 1A, 1B, which determines the charging, the holding and the discharging procedure of an ideal nozzle needle driving path. The presupposition of the charging period and the change in the load per unit time determine a nominal energy value for a subsequent energy control system. In this process, for each individual cylinder, an adaptation and equalization of different degrees of efficiency in the drive is taken into account.

As an alternative provision is made for the fact that the anticipatory control value itself is followed up by suitable repeating signals from the injection system for each individual cylinder. This can for example be a model-based or a phenomenological detection of the start of injection, the point in time of reaching the full opening of the nozzle needle or the achieved injection rate itself. As a result, manufacturing and operating point-determined tolerances of the fuel injectors can be minimized.

Figure 3:
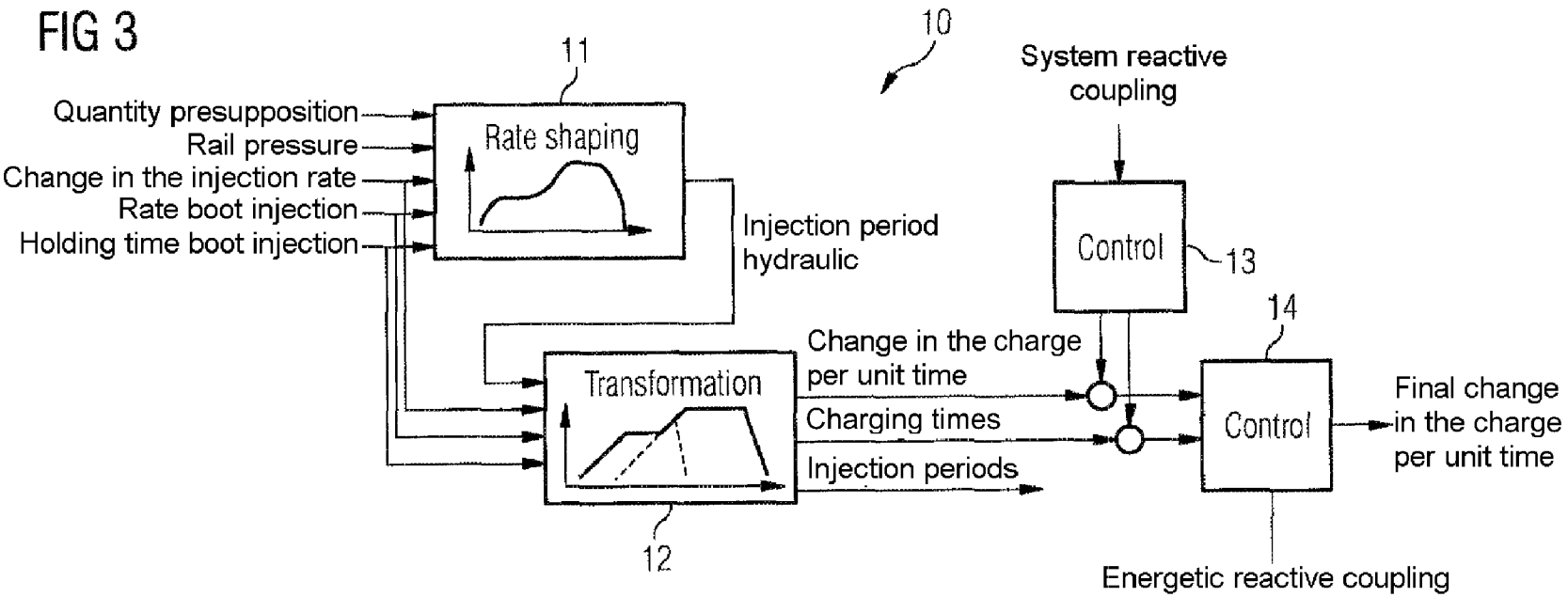
FIG. 3 shows a schematic structure of a device in accordance with various embodiments and FIG. 4 shows a block diagram of a device in accordance with various embodiments.

An exemplary embodiment for the modeling is shown in FIG. 3. FIG. 3 shows in a schematic representation a device 10 with an algorithm by means of which a control function for an injection rate course of an electric control signal can be established. Subsequently, in a first unit 11, diverse system parameters in particular a presupposition of the quantity, the rail pressure, a change in the injection rates, a rate for a boot injection and a holding time for the boot injection are entered, stored intermediately and prepared. The first unit 11 determines from the data entered the course of the electric control signal by means of which the fuel injector is driven in order to reach the desired hydraulic injection period.

The change in the injection rates, the rate for the boot injection and the holding time for the boot injection are fed in parallel to a transformer 12 and are transformed accordingly. The input of the transformer 12 is at the same time connected to the output of the first unit 11. From the data entered, the transformer 12 determines a change in the charge per unit time, the charging times and an injection period. This data is available on the output side and is connected with the output data of a first control computer (controller) 13. The first control computer 13, is connected to a system reactive coupling and supplies corresponding presuppositions for the change in the charge per unit time and for the charging times. The results are fed to a second control computer 14. From the values that were entered, the final change in the charge per unit time is determined and is available at the output. In addition, the second computer is connected to an energetic reactive coupling.

By means of the above-described method or algorithm it is possible on the basis of an injection system, which is stable in the long term with an equality function or with an adaptation for the start of the injection and the required injection quantity, to determine a free formation of the injection rate course. At the same time, a simple parametrizability can be represented.

Figure 4:
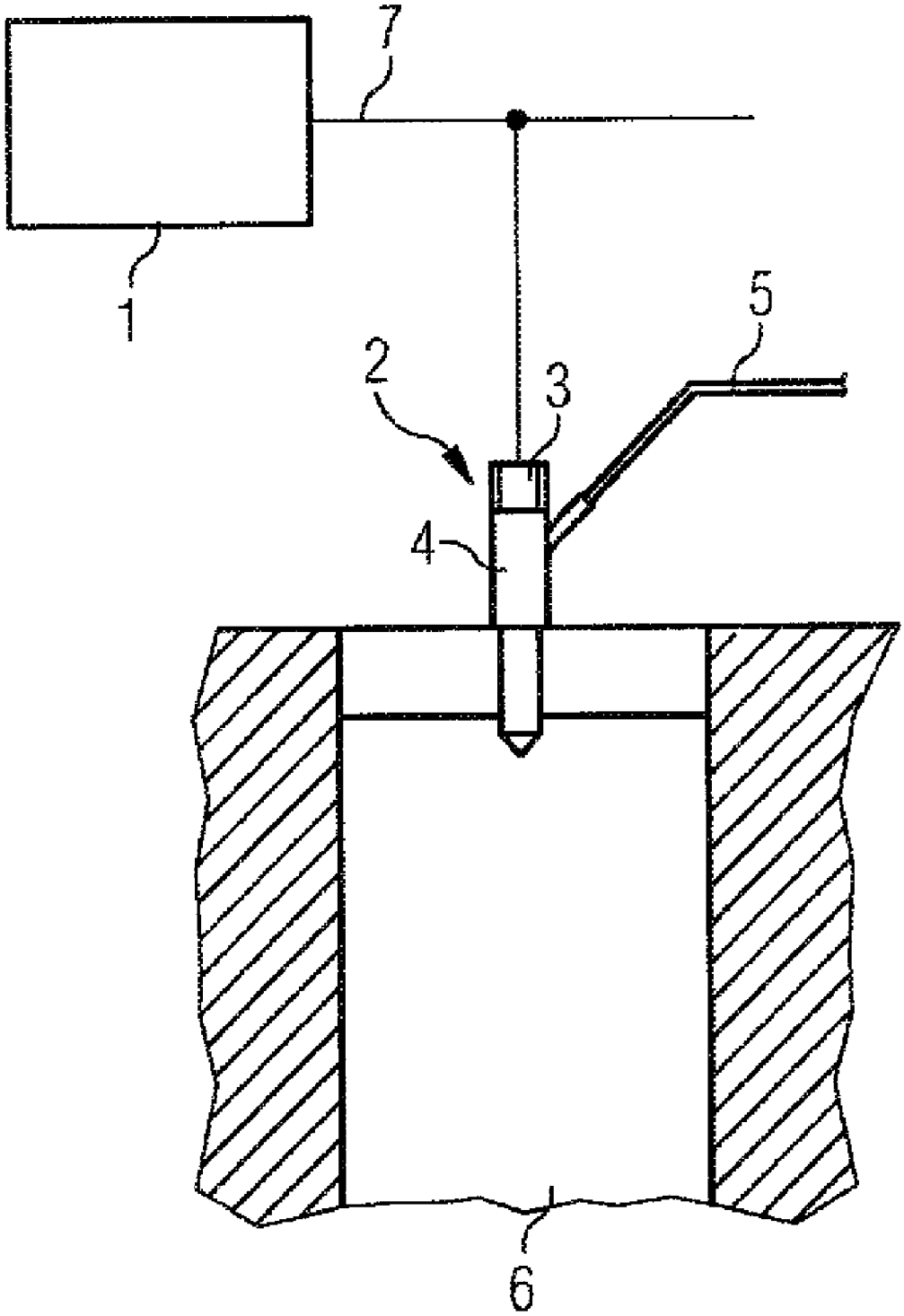

FIG. 4 shows in a schematic representation, a device 10 in accordance with various embodiments for forming an electric control signal for an injection impulse of a position-controlled fuel injector 2, in particular a common rail system or a pump nozzle injection system 10. The fuel injector 2 is arranged at a cylinder head of a cylinder 6 of an internal combustion engine. The control device 1 is connected via an electric line 7 to a piezoelectric actuator 3 of the fuel injector 2 in a preferred manner. When the actuator 3 is controlled by means of an electric control signal of the control device 1, the actuator 3 operates a nozzle needle which is arranged inside an injection nozzle 4. As a result, injection holes which are located in the bottom part of the injection nozzle 4 are opened or closed. The fuel injector 2 is supplied with fuel by means of a fuel line 5.

What is claimed is:

1. A device for forming an electric control signal for an injection impulse of a fuel injector comprising a control device by means of which a piezoelectric actuator of the fuel injector is controlled in order to inject a predetermined fuel quantity into a cylinder of an internal combustion engine and with the assistance of the course of the curve of the electric signal, an injection rate of the fuel injector is regulated wherein the control device is operable to freely form the course of the curve of the electric signal with regard to at least one pulse edge and/or an amplitude, wherein the formation of the electric signal is performed in such a way that the predetermined fuel quantity to be injected remains constant independent of the course of the electric control signal.

2. The device according to claim 1, wherein the fuel injector is part of a common rail or a pump nozzle injection system.

3. The device according to claim 1, wherein the injection rate of the fuel injector is regulated as a function of at least one of a rail pressure, a height of lift and an opening period of the fuel injector.

4. A method for forming an electric control signal for an injection impulse of a fuel injector with the electric control signal activating a piezoelectric actuator of the fuel injector in order to inject a predetermined fuel quantity into a cylinder of an internal combustion engine and with the assistance of the course of a curve of the electric control signal, an injection rate of the fuel injector being regulated as a function of at least one of the rail pressure, the height of lift and the opening period of the fuel injector, that the method comprising the steps of:

for at least a part quantity to be injected, forming the course of the electric control signal freely with regard to at least one pulse edge and/or an amplitude, embodying the forming of the injection impulse in such a way that the predetermined fuel quantity to be injected remains constant independent of the course of the electric control signal.

5. A system for forming an electric control signal for an injection impulse of a fuel injector, wherein the electric control signal activates a piezoelectric actuator of the fuel injector to inject a predetermined fuel quantity into a cylinder of an internal combustion engine and with the assistance of the course of a curve of the electric control signal an injection rate of the fuel injector is regulated, the system being operable, for at least a part quantity to be injected, to form the course of the electric control signal freely with regard to at least one of a pulse edge and an amplitude, and to form the injection impulse in such a way that the predetermined fuel quantity to be injected remains constant independent of the course of the electric control signal.

6. The system according to claim 5, wherein the injection rate of the fuel injector is regulated as a function of at least one of a rail pressure, a height of lift and an opening period of the fuel injector.

7. The system according to claim 5, wherein the injection impulse for the injection of a part quantity is subsequently embodied by means of an intermediate level with a first amplitude.

8. The system according to claim 5, wherein a change in the injection rate is predetermined for forming the injection impulse.

9. The system according to claim 5, wherein a holding time is predetermined for the intermediate level.

10. The system according to claim 9, wherein starting from the second amplitude, a speed regulation breakaway with a third change in the injection rate is predetermined.

11. The system according to claim 5, wherein the injection impulse starting from the intermediate level is set with a second change in the injection rate to a higher level with a second amplitude and for the second amplitude, a predetermined second holding time is predetermined.

12. The method according to claim 4, wherein the fuel injector is part of a common rail or a pump nozzle injection system.

13. The method according to claim 4, wherein the injection impulse for the injection of a part quantity is subsequently embodied by means of an intermediate level with a first amplitude.

14. The method according to claim 4, wherein a change in the injection rate is predetermined for forming the injection impulse.

15. The method according to claim 4, wherein a holding time is predetermined for the intermediate level.

16. The method according to claim 4, wherein the injection impulse starting from the intermediate level is set with a second change in the injection rate to a higher level with a second amplitude.

17. The method according to claim 16, wherein for the second amplitude, a predetermined second holding time is predetermined.

18. The method according to claim 16, wherein starting from the second amplitude a speed regulation breakaway with a third change in the injection rate is predetermined.

19. The method according to claim 4, wherein the number of intermediate levels, the holding period and/or the changes in the injection rate can be selected at random.

20. The method according to claim 4, wherein according to the course of the curve, an actually injected fuel quantity is determined and wherein the actually injected fuel quantity is compared to a predetermined fuel quantity.

* * * * *